US005353749A

United States Patent [19]

Seibel et al.

[11] Patent Number: 5,353,749

[45] Date of Patent: Oct. 11, 1994

[54] BOILER DESIGN

[75] Inventors: Robert V. Seibel; Theodore C. Fuhrman, Jr., both of Erie, Pa.

[73] Assignee: Zurn Industries, Inc., Erie, Pa.

[21] Appl. No.: 130,744

[22] Filed: Oct. 4, 1993

[51] Int. Cl.[5] ..... F22B 31/00

[52] U.S. Cl. ..... 122/240.1; 122/235.15; 122/235.23; 122/235.34; 122/235.35; 122/240.2; 122/240.3

[58] Field of Search ..... 122/235.15, 235.23, 122/235.34, 235.35, 240.1, 240.2, 240.3, 248, 18, 19, 14, 13.1

[56] References Cited

U.S. PATENT DOCUMENTS

| | | | |
|---|---|---|---|
| 2,529,078 | 11/1950 | French | 122/336 |
| 2,561,839 | 7/1951 | Behr | 122/336 |
| 2,860,612 | 11/1958 | Durham | 122/336 |
| 2,988,063 | 6/1961 | Vorkauf | 122/336 |
| 3,043,279 | 7/1962 | Blomquist | 122/240.1 |
| 3,198,177 | 8/1965 | Fujii | 122/236 |
| 3,221,711 | 12/1965 | Beggs | 122/240 |
| 3,245,395 | 4/1966 | Golibrzuch | 126/109 |
| 3,289,642 | 12/1966 | Schoppe | 122/240.1 |
| 4,154,568 | 5/1979 | Kendall et al. | 431/7 |
| 4,204,829 | 5/1980 | Kendall et al. | 431/7 |
| 4,318,392 | 3/1982 | Schreiber et al. | 126/110 |
| 4,412,523 | 11/1983 | Schreiber et al. | 126/92 |
| 4,492,185 | 1/1985 | Kendall et al. | 122/32 |
| 4,494,485 | 1/1985 | Kendall et al. | 122/250 |
| 4,519,770 | 5/1985 | Kesselring et al. | 431/7 |
| 4,543,940 | 10/1985 | Krill et al. | 126/92 |
| 4,550,689 | 11/1985 | Wolter | 122/248 X |
| 4,658,762 | 4/1987 | Kendall | 122/250 |
| 4,664,620 | 5/1987 | Kendall et al. | 431/328 |
| 4,730,599 | 3/1988 | Kendall et al. | 126/91 |
| 4,809,672 | 3/1989 | Kendall et al. | 126/91 |

*Primary Examiner*—Edward G. Favors

*Attorney, Agent, or Firm*—Lovercheck and Lovercheck

[57] ABSTRACT

A boiler for converting water to steam comprising a boiler enclosure having walls. An upper drum and a lower drum supported on the walls. First boiler tubes connected to the upper drum and to the lower drum. Second boiler tubes are connected to the upper drum and to the lower drum. The boiler tubes are bent in a serpentine shape having crests and bases. The crests of the first boiler tubes are spaced from the crests of the second boiler tubes. The bases of the first boiler tubes are disposed adjacent the bases of the second boiler tubes and form combustion chambers which receive cylindrical burners. A convection pass is formed between the boiler tubes and the sides, top and bottom of the enclosure. Heat absorbing tubes are located in the convection pass. Outer wall tubes are connected to the drums and supported on the inside of the enclosure walls. Heat transfer tubes are placed between the boiler tubes and the outer border tubes.

27 Claims, 7 Drawing Sheets

BOILER DESIGN

BACKGROUND OF THE INVENTION

This invention relates to water tube boilers fitted with burners which are intended to combust gaseous or liquid fuels where low levels including ultra low levels of emissions of gaseous oxides of nitrogen ($NO_x$) are required. Low levels of $NO_x$ is defined as concentrations less than 50 parts per million parts and ultra low $NO_x$ is defined as concentrations of less than 10 parts per million parts in combustion gases that are discharged to the atmosphere.

Oxides of Nitrogen ($NO_x$) are unwanted atmospheric pollutants that are formed by high temperature chemical reactions between nitrogen in combustion air or in fuel and oxygen in combustion air. For boilers, $NO_x$ are combustion formed gases generated by utilizing gaseous, liquid or solid fuels for the generation of steam where temperatures in the highly turbulent flames approach the adiabatic temperature.

Several techniques of combustion modification are important to control the level of $NO_x$ in boiler off-gases and all rely on a means to reduce maximum flame temperature. All of the means of combustion modification rely on the integration of boiler design with burner characteristics to produce the lowest possible flame temperature. This integration involves setting a relationship between the amount of radiant heat absorbing surface of the boiler tube walls making up the combustion chamber and the combustion volume devoted to a single burner. Conventional water tube boilers, which have non-partitioned combustion chambers, have a geometric relationship between the volume contained by the water-cooled walls of the combustion chamber and the surface of the walls. As dimensions between walls are increased to produce larger combustion volumes required for greater capacities, the amount of surface of the walls increases, but not at the same proportion. Volume increases are greater than the attendant increase in radiant heating surface.

Flame temperatures (which are inversely influenced by the amount of radiant surface) are greater at higher capacity if, by design, the volume of the combustion chamber relative to heat input is held constant. Or, if the ratio of radiant surface to heat input is held constant, combustion volume increases unnecessarily and the overall dimensions of the boiler will increase.

The utilization of clean gaseous fuels, such as natural gas, and clean liquid fuels, such as distillate fuel oil, to generate steam is well known for convenience, less restrictive design and few operational problems. Also, using clean gaseous fuels is encouraged because the amount of photo-chemical and other air pollutants discharged into the atmosphere will be lower. One of the air pollutants of primary concern are chemical compounds of nitrogen and oxygen identified as $NO_x$ and usually reported chemically as $NO_2$. $NO_x$ is photochemical contributing to smog and acid rain. Experience has shown that the average temperature at which combustion takes place and also the maximum temperature that occurs when a fuel is burned have direct relationships to the amount of $NO_x$ that will be formed. This means that higher flame temperatures within a boiler combustion chamber will increase the amount of $NO_x$ formed and discharged from the boiler.

This invention provides a combustion chamber design that utilizes well-known principles of radiant heat transfer combined with novel arrangements of the boiler's water tubes to absorb heat from fuels as they are being burned so as to lower combustion temperatures and thus, prevent formation of significant quantities of $NO_x$.

The relationship between furnace walls heat absorbing surface and combustion volume is different with the novel design since there are a number of individually partitioned combustion chambers in parallel to each other. A separate burner is fitted to each combustion chamber. The design offers a way to have reasonably similar relationships of combustion volume and radiant heat absorbing surface for any boiler capacity. Additionally, the separate chambers will increase the radiant heat absorbing surface for the combustion volume normally seen for conventional boilers, thus, it offers a means for naturally decreasing maximum flame temperatures and thermally produced gaseous emissions.

Applicant is aware of the following U.S. patents: French 2,529,078; Behr 2,561,839; Druham 2,860,612; Vorkauf 2,988,063; Fujii 3,198,177; Beggs 3,221,711; Golibruzuch 3,245,395; Kendall, et al 4,154,568; Kendall, et al 4,204,829; Schreiber, et al 4,318,392; Schreiber, et al 4,412,523; Kendall, et al 4,492,185; Kendall, et al 4,494,485; Kesselring, et al 4,519,770; Krill, et al 4,543,940; Kendall 4,658,762; Kendall, et al 4,664,620; Kendall et al 4,730,559; and, Kendall, et al 4,809,672.

SUMMARY OF THE INVENTION

The discrete, parallel combustion chambers in the boiler design according to the present invention are formed by bending boiler tubes and positioning the tubes adjacent to the others to form cavities that have an open discharge at one end and that are bounded by boiler tubes on all sides and the burner at the end opposite of the discharge. The novel design would be limited to a water tube boiler where boiler tubes along the sides are bent to form the cavities that provide combustion volume.

Variations of the design could be: Openings between the tubes bordering the cavities. Openings would allow limited communication of gases between cavities and make sure that there was a means for pressure equalization. Bordering portions that were completely closed. This could be done by either adjusting tube diameter or installing weldments between tubes so that there was no communication between cavities and where the weldments between tubes would add to, and thus, create the maximum amount of radiant heat absorbing surface. Different relationships between the cross sectional area of a cavity and the length between end to end. Different geometric shapes of the cross section of the bordering portions. The cross section could be circular, oval, or made up of a form that has straight sides like a hexagon or octagon. Different arrays of parallel chambers. The cavities could be either in line vertically and horizontally, off-set in either direction, or in-line in one direction and offset in the other. Bordering walls could be the same tubes where one row of tubes acts as a partition for two cavities or there could be separate rows of tubes used to form the cavities.

It is an object of the present invention to provide a novel boiler design that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figure 1:
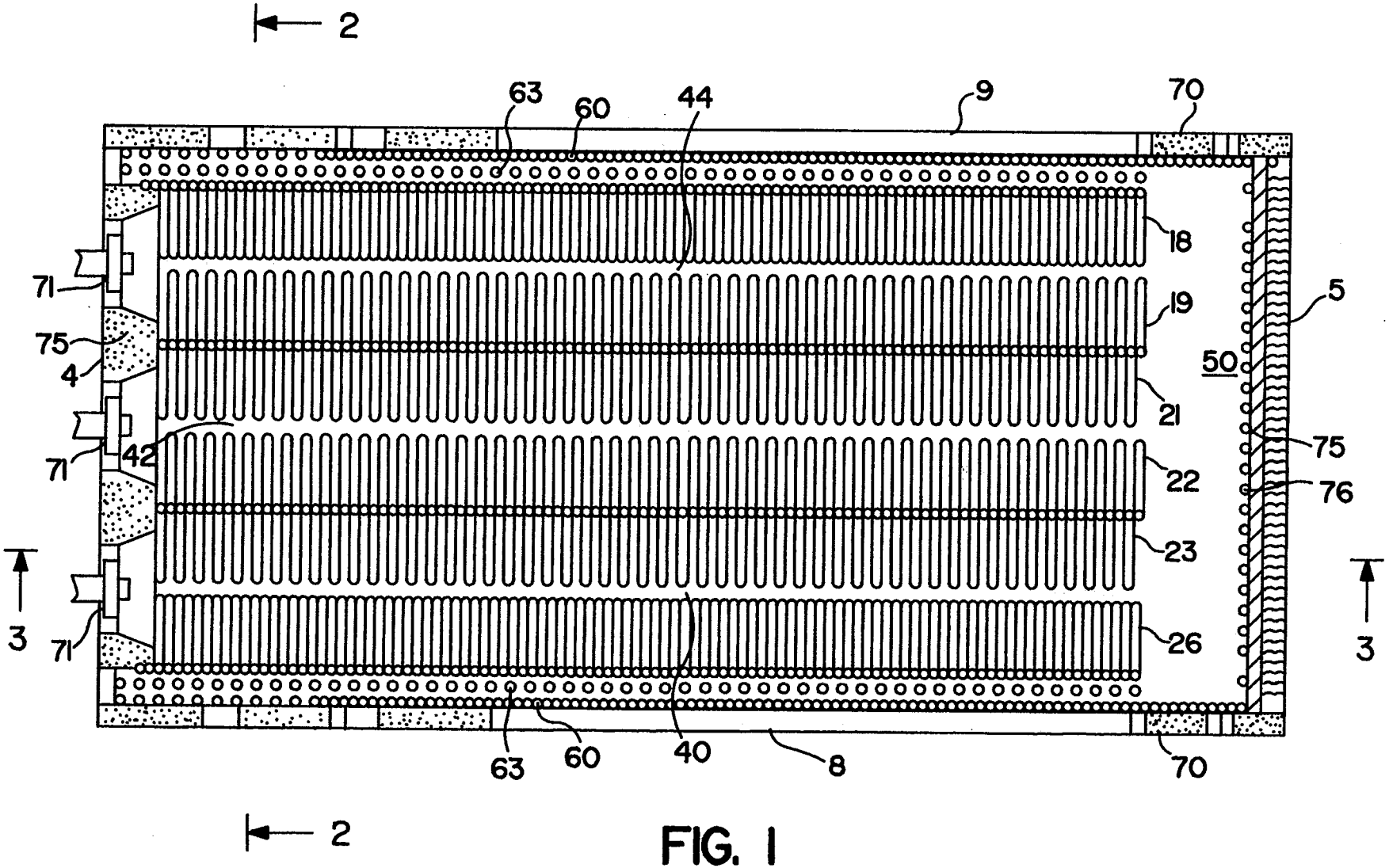
FIG. 1 is a cross sectional view of the boiler taken on line 1—1 of FIG. 3.
Figure 1A:
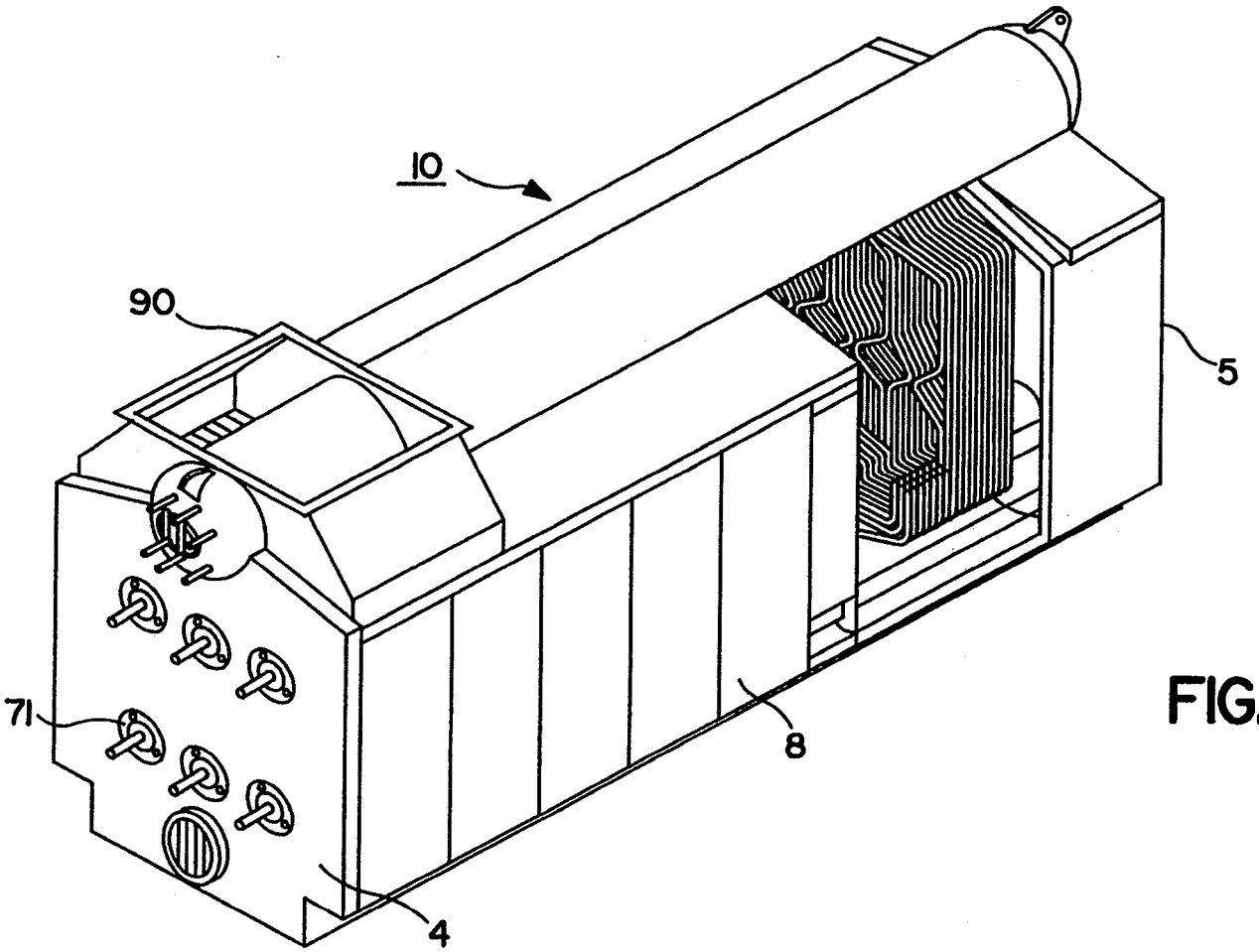
FIG. 1A is an isometric view of a boiler of the type disclosed herein.

Now with more particular reference to the drawings, the figures depict a typical water tube boiler 10 meant to generate steam from water that is inside tubes that absorb heat from combustion of gaseous or liquid fuels. Boiler has enclosure 12, formed by front wall 4, rear wall 5, top 6, bottom 7 and side walls 8,9. Front wall 4, rear wall 5, top 6, bottom 7 and side walls 8,9 are made of insulating materials 70, welded steel and refractory 75 and constructed in a manner familiar to those skilled in the art. Top 6 has exhaust opening 90.

Upper header 14 (or drum) and lower header 16 (or drum) are generally cylindrical. Any suitable arrangement of headers, drums or other arrangements of water tube construction could be used to attach boiler tubes 18,19,21,22,23 and 26 directly to header 14.

Boiler tubes 18,19,21,22,23, and 26 are connected to upper header 14 and to lower header 16. It is anticipated that the invention can be applied to other arrangements of drums and to other arrangements of water tube connections that may not be attached directly to the headers. Any number of separate combustion chambers 40 can be provided and arranged in parallel. Boiler tubes 18,19,21,22,23 and 26 form combustion chambers 40–45. Vertically disposed parallel boiler tubes 18,19,21,22,23 and 26 form elongated partitions. The boiler tubes are bent generally in a serpentine shape having bases 20 and crests 24. Base 20 of each adjacent boiler tube is disposed adjacent a base 20 of an adjacent boiler tube. Each crest 24 is spaced from crest 24 of an adjacent boiler tube which provides elongated combustion chambers 40–45 that are arranged in both vertical and horizontal rows relative to one another. Outer border tubes 60, form partitions between side walls 8,9 and boiler tubes 18,19,21,22,23 and 26. Outer border tubes 60 are connected to upper header 14 and to lower header 16. Heat absorbing tubes 63 and outer border tubes 60, on the inside of side wall 8, are connected to upper header 14 and to lower header 16.

Figure 12:
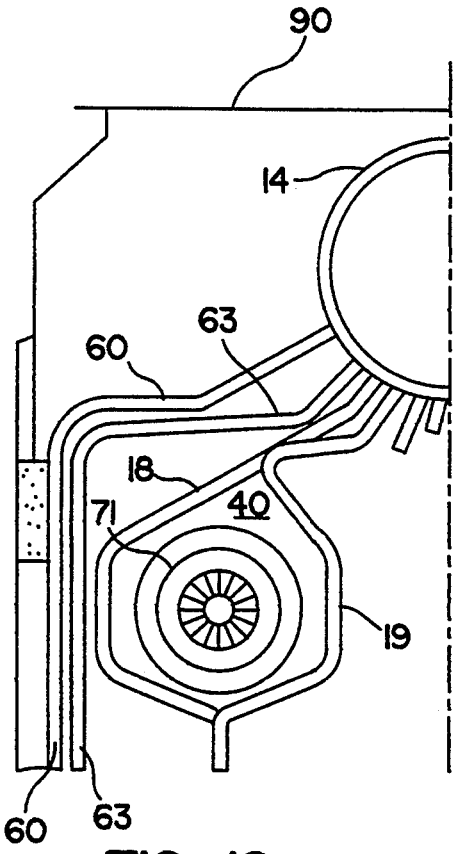
FIG. 12 is an enlarged partial view, similar to FIG. 3, of another embodiment of the invention.
Figure 13:
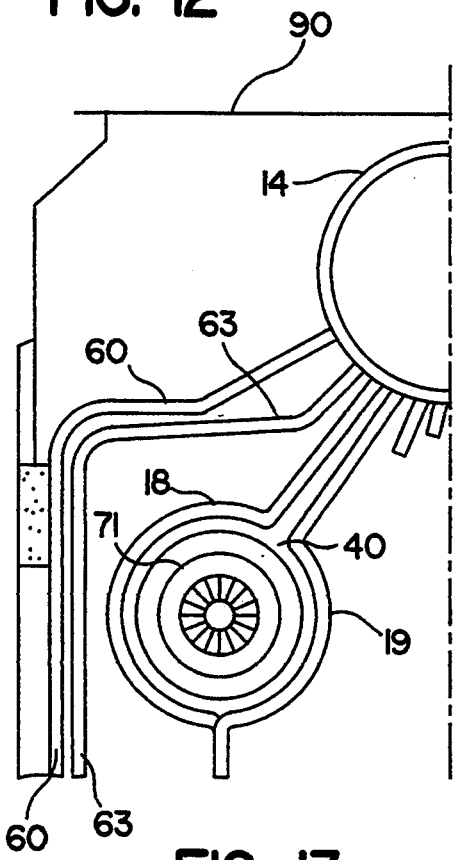
FIG. 13 is a view similar to FIG. 12, of another embodiment of the invention.

Other variations of the shapes of tubes than that shown can be used. Examples of other shapes of combustion chambers 40–45 are shown in FIGS. 12 and 13. In FIG. 12, boiler tubes 19 are bent generally into the form of an equal sided polygon. The tubes could also be bent into the form of a circle, as shown in FIG. 13. The boiler tubes can be formed into other geometrical shapes; for example, they could be bent into an oval shape or a circular shape. Boiler 10 may have a variety of arrangements of partition tubes and gas sealing devices.

Gas space 50 is provided between combustion chambers 40–45 and rear wall 5. Combustion chambers 40–45 exhaust into gas space 50 which is connect to convection pass 51. Each combustion chamber 40–45 contains burner 71. Burner 71, may be natural draft, forced draft where fuel and air are injected into burner 71 separately or may be of a type where fuel and air is premixed. Combustion gases in convection pass 51 are cooled by heat transfer to water inside heat absorbing tubes 63, convection pass bordering boiler tubes 18 and 26 and outer border tubes 60.

Figure 3:
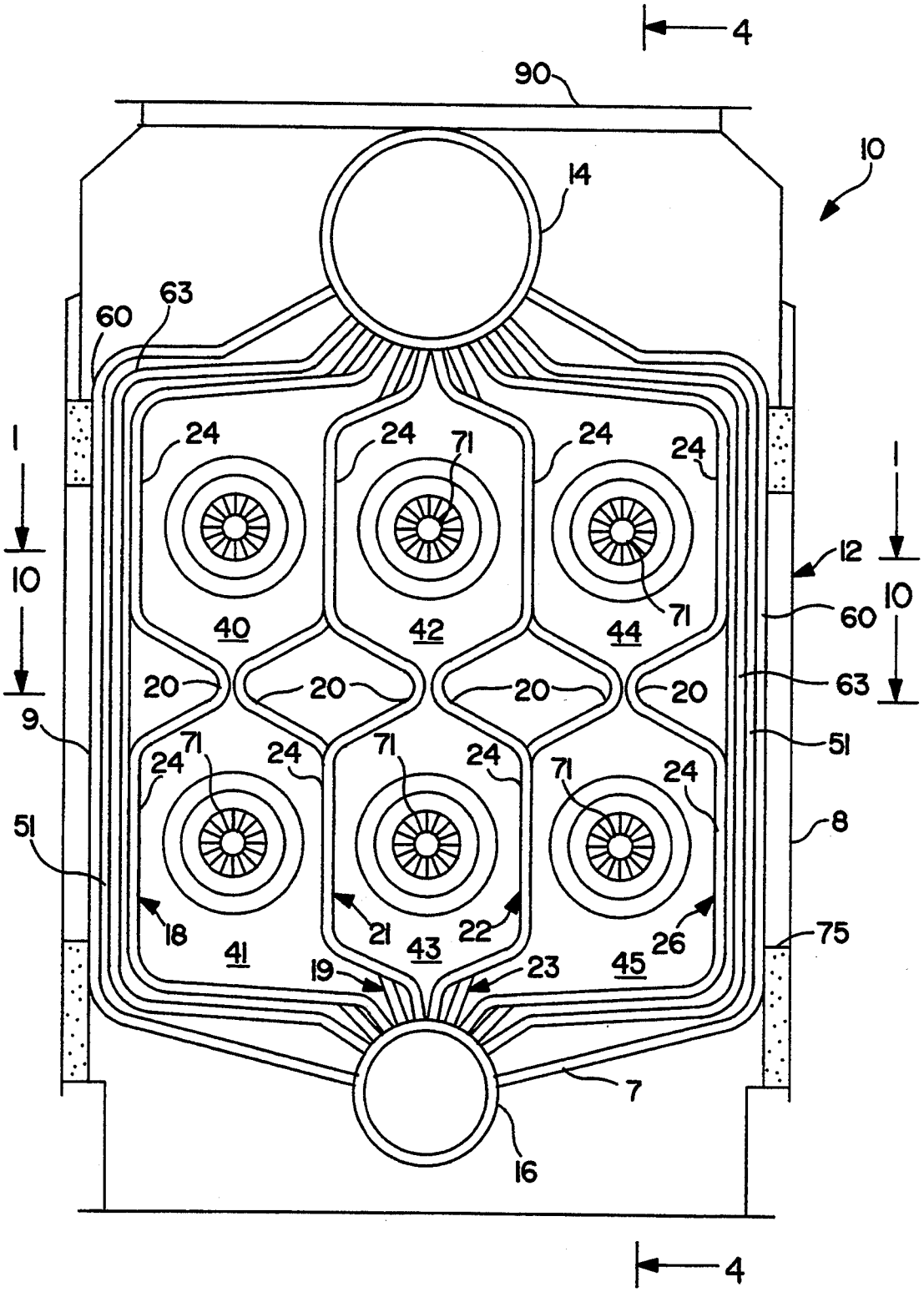
FIG. 3 is a cross sectional view taken on line 3—3 of FIG. 4.
Figure 4:
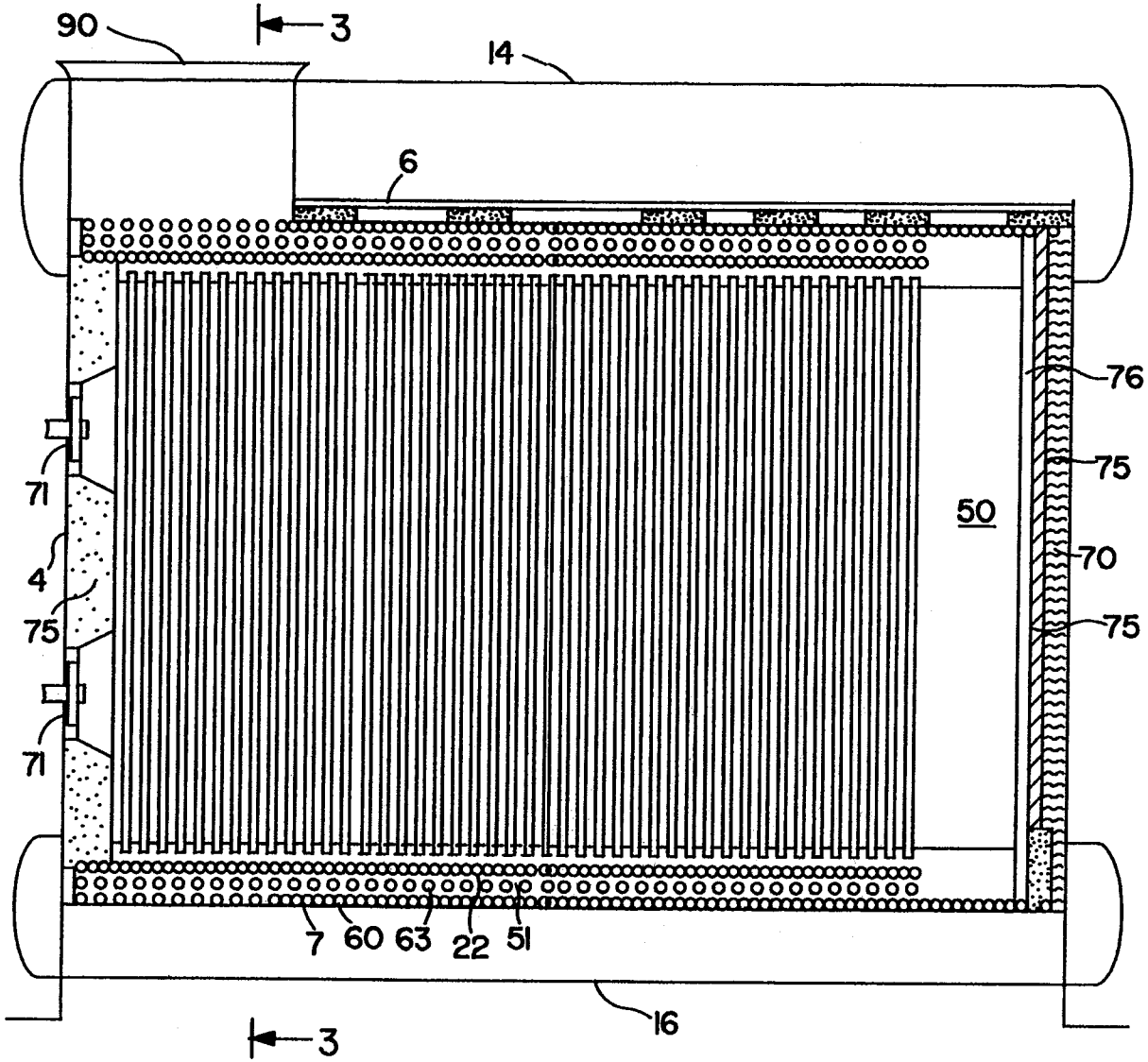
FIG. 4 is a cross sectional view taken on line 4—4 of FIG. 3.

In FIGS. 1 and 3, boiler 10 has plurality of boiler tubes 19 and 22 that are arranged to obtain multiple, parallel combustion chambers 40–45.

Figure 2:
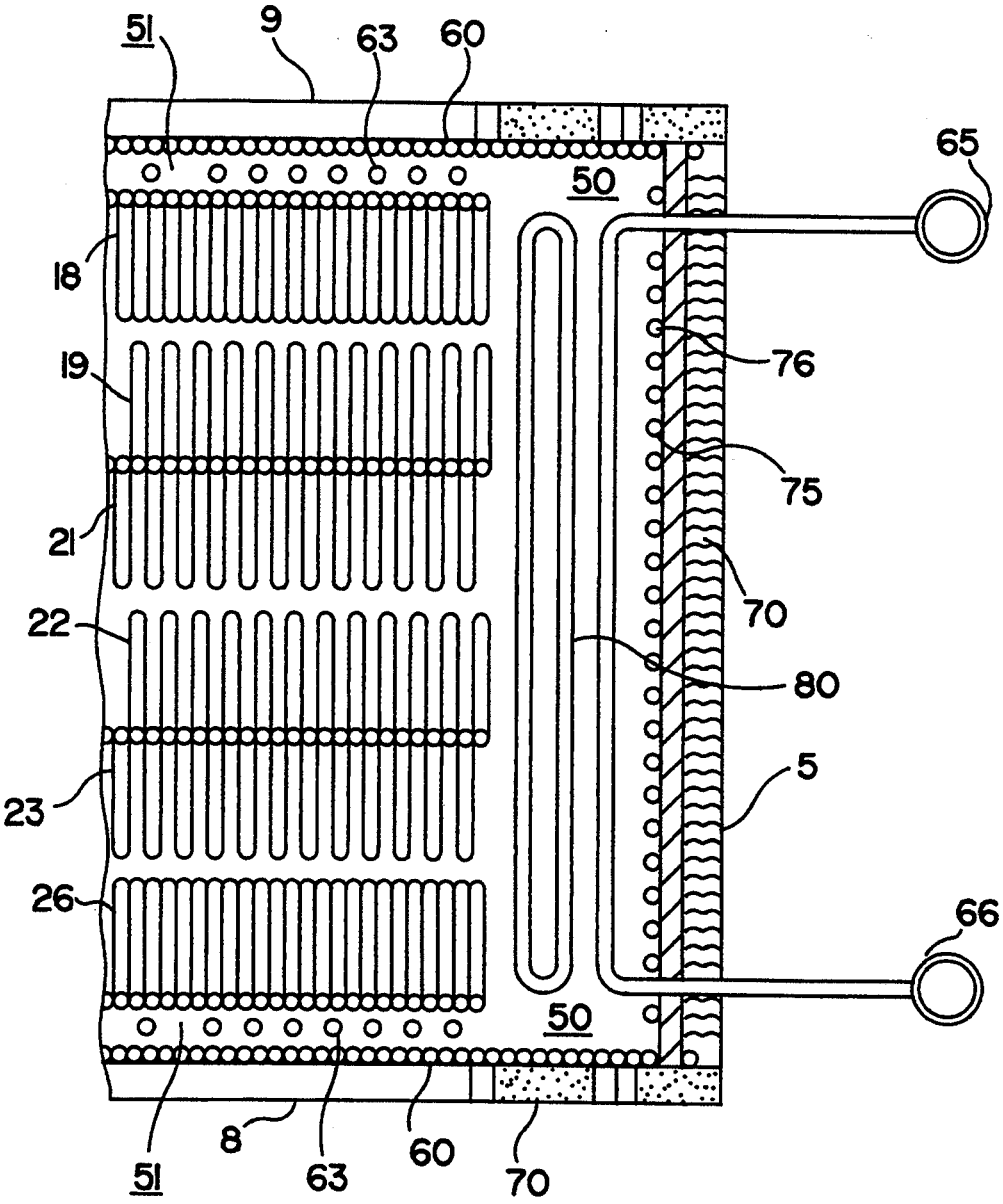
FIG. 2 is a partial cross sectional view, similar to FIG. 1, of another embodiment of the invention.

FIG. 2 shows an embodiment of boiler 10 with a heat transfer component 80 in gas space 50. It is possible to utilize the invention in a way that would allow heat transfer component 80 to absorb heat and be connected to a separate device by connections 65,66. Heat transfer component 80 is located in gas space 50 adjacent to combustion chambers 40–45 and convection pass 51. The location and design of heat transfer component 80 is controlled by the amount of heat transfer required between combustion gases and the fluid flowing through heat transfer component 80.

Figure 5:
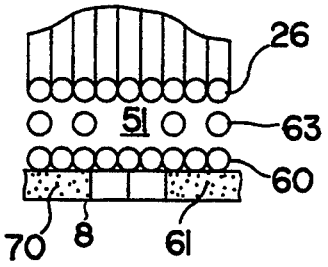
FIG. 5 is a partial enlarged view of FIG. 1.

FIG. 5 shows an embodiment of tubes wherein outer border tubes 60 are disposed parallel to each other in side-by-side relation, forming an outer wall partition using overlying metal sheet 61 which forms a seal between outer border tubes 60 and insulating materials 70. A row of spaced heat absorbing tubes 63 is disposed between boiler tubes 18,19,21,22,23 and 26 and outer border tubes 60.

Figure 6:
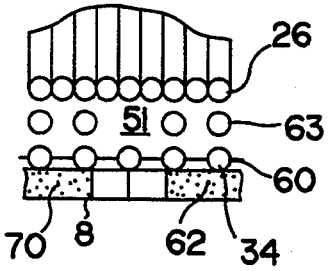
FIG. 6 is a partial enlarged view, similar to FIG. 5, of another embodiment of the invention.

FIG. 6 shows an embodiment wherein outer border tubes 60 are spaced at intervals from one another along side walls 8,9. Metal bars 62 are welded in position to outer border tubes 60 forming a sealed bordering wall between outer border tubes 60 and insulating materials 70.

Figure 7:
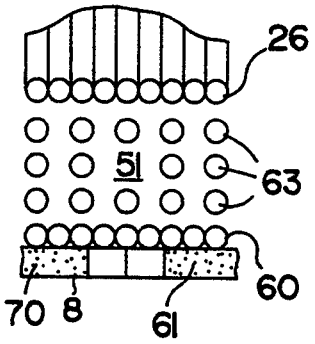
FIG. 7 is a partial enlarged view, similar to FIG. 5, of another embodiment of the invention.

FIG. 7 shows an arrangement of tubes similar to FIG. 5, wherein three spaced rows of spaced heat absorbing tubes 63 are disposed between convection pass bordering boiler tubes 18 and 26 and outer border tubes 60. Metal sheet 61 is disposed between outer border tubes 60 and insulating materials 70. Front wall 4 may be made of cast refractory construction to support burners 71 and to insulate against higher temperature combustion gases in boiler 10.

Figure 8:
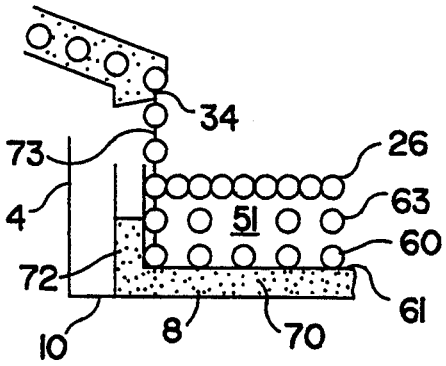
FIG. 8 is a partial enlarged view, similar to FIG. 1, of another embodiment of the invention.

An optional arrangement would be to construct front wall 4 using bent tubes 72, shown in cross section in FIG. 8, separated by bars 73 and continuously sealed by welds 34.

Figure 9:
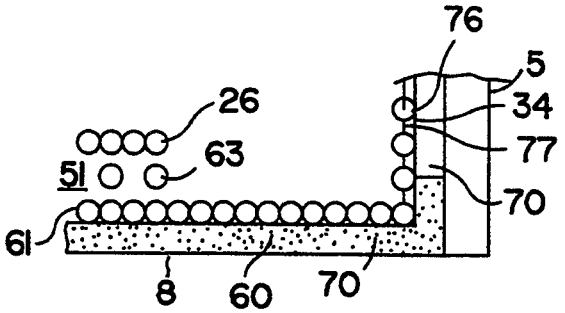
FIG. 9 is a partial enlarged view, similar to FIG. 1, of another embodiment of the invention.
Figure 10:
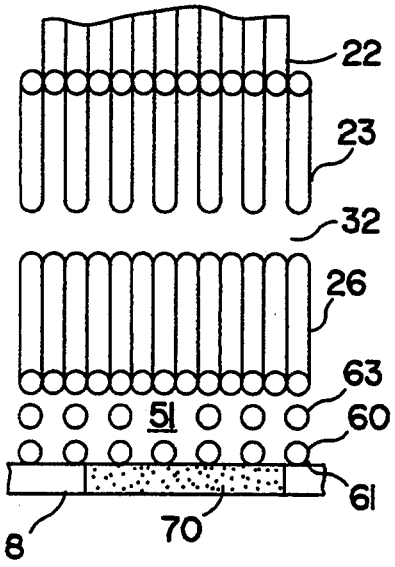
FIG. 10 is a partial enlarged cross sectional view taken on line 10—10 of FIG. 3.

Rear wall 5 has outer border tubes 76 set at spaces along a vertical plane that is essentially parallel to the plane formed by the face of refractory 75. An optional arrangement of the construction of rear wall 5 is shown in FIG. 9 wherein outer border tubes 76 are in a vertical plane and separated by bars 77 continuously sealed at all edges by welds 34.

Figure 11:
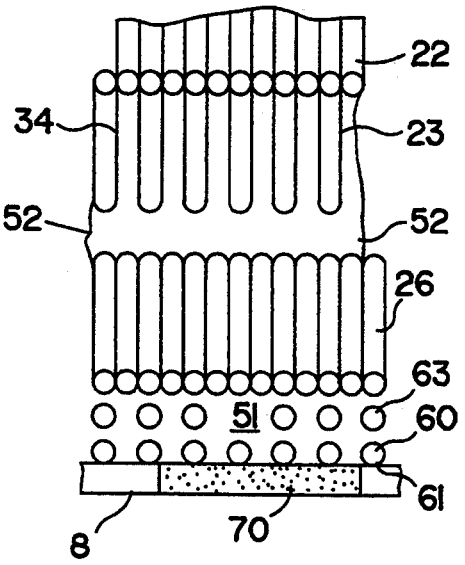
FIG. 11 is an enlarged partial view, similar to FIG. 10, of another embodiment of the invention.

FIG. 11 shows an arrangement where each individual combustion chamber 40–45 is completely sealed by installing plates 52 specially configured to fit between boiler tubes 19,21,22 and 23. The space between boiler tubes 19,21,22 and 23 is sealed by welds 34 where the boiler tubes are spaced at some distance from one another.

FIG. 12 shows boiler tube 23 curved to extend between two adjacent boiler tubes 22. Curved boiler tube 23 provides opening 32 between adjacent combustion chambers 40 and 41, for example.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A boiler comprising a front wall, a rear wall, a top, a bottom, and side walls forming an enclosure;

hollow partitions made of first boiler tubes and second boiler tubes defining combustion chambers;

an upper header and a lower header supported on said enclosure and connected to each of said boiler tubes;

each of said boiler tubes being curved in a serpentine form each having at least two cycles;

each of said cycles having at least one base and one crest;

said base of each of said first boiler tubes being disposed between said base of two adjacent said second boiler tubes forming a first combustion chamber and a second combustion chamber between said crests of two said boiler tubes; and, a burner disposed in each said combustion chamber.

2. The boiler recited in claim 1 wherein said boiler tubes having ends;

one said end of each said boiler tube being attached to said upper header and the other said end of each said boiler tube being attached to said lower header.

3. The boiler recited in claim 2 wherein said bases of said first boiler tubes and said bases of said second boiler tubes are disposed adjacent one another providing limited communication of gas between said combustion chambers.

4. The boiler recited in claim 3 wherein said boiler tubes are disposed in side-by-side relation to each other.

5. The boiler recited in claim 3 wherein third boiler tubes are disposed adjacent said second boiler tubes arranged with one of said third boiler tubes between each of said second boiler tubes and fourth boiler tubes are spaced from said second boiler tubes and from said third boiler tubes.

6. The boiler recited in claim 5 wherein fifth boiler tubes are connected to said upper header and to said lower header;

sixth boiler tubes are connected to said upper header and to said lower header;

each of said fifth boiler tubes and each of said sixth boiler tubes having a base and a crest;

said crests of said fifth boiler tubes being spaced from said crests of said sixth boiler tubes providing a fifth combustion chamber and a sixth combustion chamber;

said crests of said fifth boiler tubes being disposed between said crests of said fourth boiler tubes whereby said combustion gases in said fifth combustion chamber and in said sixth combustion chamber are brought into contact with both said fourth boiler tubes and said fifth boiler tubes.

7. The boiler recited in claim 6 wherein outer border tubes are connected to said upper header and to said lower header and extend along said side walls forming an outer border partition between said sixth boiler tubes and said side walls.

8. The boiler recited in claim 7 wherein said outer border tubes are disposed adjacent said sides of said enclosure connected to said upper header and to said lower header;

a metal sheet, attached to said side walls and disposed between and forming a cover for said side walls;

said outer border tubes form a shield for said side walls from gases of combustion.

9. The boiler recited in claim 8 wherein heat transfer tubes are connected to said upper header and to said lower header and are disposed between said boiler tubes and said outer border tubes.

10. The boiler recited in claim 9 wherein plates are fixed to some of said bases of said boiler tubes whereby connection between said combustion chambers is limited.

11. A boiler comprising an elongated enclosure;

said enclosure having a front wall, a rear wall and side walls;

an upper header and a lower header supported on said enclosure;

elongated partitions in said enclosure extending from said front wall to a position adjacent said rear wall providing a gas space;

said elongated partitions having spaces therein;

said partitions comprising tubes for receiving water;

said tubes being connected to said upper header and to said lower header;

said elongated partitions being formed in a generally serpentine shape;

said generally serpentine shape having bases and crests;

said crests of each said elongated partition being spaced from a crest of a said elongated partition adjacent thereto;

each said base of each said elongated partition being disposed between a base of a said elongated partition adjacent thereto whereby combustion chambers are defined between each two adjacent said elongated partitions; and a burner is disposed in each said combustion chamber.

12. The boiler recited in claim 11 wherein said gas space is disposed between said partitions and said rear wall;

said boiler having an exhaust opening; and, a convection pass between said boiler tubes and said side walls connecting said gas space to said exhaust opening.

13. The boiler recited in claim 12 wherein outer boiler tubes are disposed in said convection pass;

said outer boiler tubes being connected to said upper header and to said lower header.

14. The boiler recited in claim 13 wherein a heat transfer component is disposed in said gas space; and, said heat transfer component having ends adapted to be connected to a device independent of said boiler.

15. The boiler recited in claim 14 wherein said combustion chambers are disposed in vertical rows.

16. The boiler recited in claim 15 wherein said combustion chambers are arranged in vertical and horizontal rows.

17. The boiler recited in claim 16 wherein said elongated partitions are boiler tubes.

18. The boiler recited in claim 16 wherein some of said combustion chambers that are arranged in vertical rows are separated from one another by a single said partition.

19. The boiler recited in claim 18 wherein said combustion chambers are generally circular in cross section.

20. The boiler recited in claim 19 wherein said combustion chambers are generally polygonal in cross section.

21. The boiler recited in claim 20 wherein a heat absorbing element is disposed between said boiler tubes and said outer boiler tubes.

22. The boiler recited in claim 21 wherein three said heat absorbing elements are disposed between said combustion chambers and said outer boiler tubes.

23. The boiler recited in claim 22 wherein said combustion chambers terminate in spaced relation to said rear wall defining said gas space between said combustion chambers and said rear wall and a super heater coil is disposed in said gas of combustion.

24. A boiler comprising an enclosure defined by a front wall, a rear wall, a top, a bottom and side walls;

individual combustion chambers in said enclosure;

said combustion chambers extending from said front wall and terminating adjacent said rear wall and providing a gas space between said combustion chambers and said rear wall;

said combustion chambers being formed of curved partitions;

said curved partitions comprising boiler tubes supported in side-by-side relation to one another; and, burners supported on said front wall;

a said burner disposed in each said combustion chamber;

an exhaust opening in said top adjacent said front wall;

said combustion chambers being spaced from said side walls providing a gas space between said combustion chambers and said side walls;

said combustion chambers providing a path for gas of combustion from said combustion chambers through said space to said exhaust opening;

an upper header means supported on said top; and, a lower header means supported on said enclosure below said upper header means.

25. The boiler recited in claim 24 wherein each of said boiler tubes are formed into a serpentine shape having bases and crests;

each said crest of each said boiler tube being disposed in spaced relation to a said crest of an adjacent said boiler tube; and, each said base of each said boiler tube being disposed adjacent a said base of an adjacent said boiler tube thereby providing said combustion chambers between said crests.

26. The boiler recited in claim 25 wherein outer border tubes are fixed to said side walls in a convection pass;

said outer border tubes each having two ends;

one of said ends of each said outer border tube being connected to said upper header means;

the other end of each said outer border tube being connected to said lower header means.

27. The boiler recited in claim 26 wherein convection pass tubes are disposed in said convection pass between said outer border tubes and said boiler tubes.

* * * * *